US007066267B2

(12) United States Patent
Hall

(10) Patent No.: US 7,066,267 B2
(45) Date of Patent: Jun. 27, 2006

(54) DOWNHOLE TUBULAR SPLITTER ASSEMBLY AND METHOD

(75) Inventor: Douglas D. Hall, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 10/924,388

(22) Filed: Aug. 23, 2004

(65) Prior Publication Data

US 2005/0077048 A1 Apr. 14, 2005

Related U.S. Application Data

(60) Provisional application No. 60/498,003, filed on Aug. 26, 2003.

(51) Int. Cl.
*E21B 15/04* (2006.01)
*E21B 7/08* (2006.01)

(52) U.S. Cl. ..... 166/313; 166/366; 175/82

(58) Field of Classification Search ..... 175/5, 175/82, 78, 83; 166/313, 341, 349, 366
See application file for complete search history.

(56) References Cited

U.S. PATENT DOCUMENTS

| | | | | |
|---|---|---|---|---|
| 4,068,729 | A | 1/1978 | Peevey | |
| 4,222,611 | A | 9/1980 | Larson et al. | |
| 4,396,075 | A | 8/1983 | Wood et al. | |
| 4,396,230 | A | 8/1983 | Wool et al. | |
| 4,415,205 | A | 11/1983 | Rehm et al. | |
| 4,474,236 | A | 10/1984 | Kellett | |
| 4,573,541 | A | 3/1986 | Josse | |
| 4,640,353 | A | 2/1987 | Schuh | |
| 4,742,871 | A | 5/1988 | Miffre | |
| 4,807,704 | A | 2/1989 | Hsu et al. | |
| 5,330,007 | A | 7/1994 | Collins et al. | |
| 5,458,199 | A | 10/1995 | Collins et al. | |
| 5,477,925 | A | 12/1995 | Trahan et al. | |
| 5,560,435 | A | 10/1996 | Sharp | |
| 5,655,602 | A | 8/1997 | Collins | |
| 5,685,373 | A | 11/1997 | Collins et al. | |
| 5,810,086 | A | 9/1998 | Bridges | |
| 5,865,260 | A | 2/1999 | Jackson et al. | |
| 5,878,815 | A * | 3/1999 | Collins | 166/313 |
| 5,918,675 | A | 7/1999 | Borak et al. | |

(Continued)

OTHER PUBLICATIONS www.davis-lynch.com/catalog, Davis Inner-String Cementing Equipment.

(Continued)

*Primary Examiner*—Frank S. Tsay
(74) *Attorney, Agent, or Firm*—Browning Bushman P.C.

(57) ABSTRACT

A splitter assembly 10 is positioned downhole within a conductor 50 for separating two or more tubular strings placed within the conductor. A splitter housing may include a first bore 26 and a second bore 28 for separating a first well from a second well, and a plug 24 positioned in one of the bores including a top face 25 sloping downwardly toward the other bore. One or more guide plates 18 secured to the splitter housing and positioned above the plug guide a bit or other tool toward one of the first bore and the second bore. The splitter housing 10 may be positioned along the conductor 50 after the conductor is jetted in place. According to the method, the plug in one of the bores is retrieved after a casing is run in one well, so that the second bit and the second casing will pass through the bore which previously included the plug.

28 Claims, 20 Drawing Sheets

U.S. PATENT DOCUMENTS

| | | | | |
|---|---|---|---|---|
| 6,142,235 | A | 11/2000 | Monjure et al. | |
| 6,182,760 | B1 | 2/2001 | Phelps | |
| 6,305,475 | B1 | 10/2001 | Carnahan et al. | |
| 6,336,507 | B1 * | 1/2002 | Collins | 166/313 |
| 6,349,769 | B1 | 2/2002 | Olmer | |

OTHER PUBLICATIONS

Kvaerner National, Inc., Splitter Wellhead System Literature.

* cited by examiner

DOWNHOLE TUBULAR SPLITTER ASSEMBLY AND METHOD

RELATED CASE

This Application claims priority from U.S. application Ser. No. 60/498,003 filed on Aug. 26, 2003.

FIELD OF THE INVENTION

The present invention relates to equipment and methods for drilling and completing two or more wells and, more particularly, to completing two or more subsea wells within a single conductor.

BACKGROUND OF THE INVENTION

Various systems have been devised for drilling and completing two or more offshore wells through a conductor pipe which extends upward to a single wellhead. U.S. Pat. No. 5,458,199 discloses an assembly for drilling and completing multiple subterranean wells from a common wellbore. A single riser with two wellheads is disclosed in U.S. Pat. No. 5,810,086. Techniques for completing and cementing a juncture with lateral wellbores are disclosed in U.S. Pat. No. 5,477,925. More recently, U.S. Pat. No. 6,279,658 discloses a method of forming two wellbores from a single wellbore. Other relevant patents include U.S. Pat. Nos. 5,330,007, 4,807,704, 4,742,871, 4,640,353, 4,573,541, 4,415,205, 4,396,230, 4,396,075 and 4,068,729.

For offshore drilling and completing operations, a conductor pipe is conventionally jetted or otherwise driven into the sea floor. From within this conductor, the operator sequentially drills two or more holes of production casing strings. The driller needs to ensure that the drilled holes do not overlap, breaking into each other's bore. To prevent overlap, various styles of splitters or guide assemblies have been devised.

One solution is to provide a separator curtain from the surface, with the curtain effectively forming a wall with intermittent struts, tubes or other structural shapes acting as guides. The separator curtain may resemble a single wall across the center of the pipe, or one may provide an alternative X configuration. Providing a single wall across the pipe center may result in north-south separation, but no control in the east or west direction, allowing the drill string to wander before the conductor wall and the separator curtain prohibit sideways movement. The X profile is thus preferred for many applications, since it provides a more definite and precise separation in north, south, east and west directions. These designs may maintain an open bore during the drilling operation and then subsequently are installed to provide separation and guidance of the drill string. The separator curtain design is, however, heavy and awkward, and expensive and time consuming to deploy.

An alternative splitter assembly may utilize one or more conductor joints, with a web or portion of a separator curtain welded in place within the conductor joints. Manufacturing and deploying expenses are reduced, and this separator desirably serves its purpose near the bottom of the conductor. The partial blocking of the conductor bore by the webbed, or other partial separator curtain, results in a significant drag during the operation of driving the conductor joints into the sea floor.

A further alternative directly drives an open bore conductor into a seabed, then runs a sleeve assembly through the conductor down to the shoe at the lower end of the conductor. The sleeve may serve as a guide to ensure that the sequentially drilled holes maintain separation, and may thereafter diverge slightly outward. The conductor bore which supports the sleeve provides a continuous support shoulder, which undesirably blocks off the bore, making driving to the desired depth more difficult. The sleeve assembly is also complex, expensive to manufacture, and utilizes a rather complex cycling procedure to index for proper alignment.

Yet other splitters or downhole guide assemblies have been proposed which do not rotate or index over the proper bore, and instead rely on axially staggered spacing between a primary and a secondary bore. The operator may tally string length and thereby estimate which staggered height bore has been entered. A staggered length between the primary and secondary bores is thus desirable for the operator, but also increases the length of the assembly, which is highly undesirable.

The disadvantages of the prior art are overcome by the present invention, and an improved downhole splitter or guide assembly and method are hereinafter disclosed.

SUMMARY OF THE INVENTION

The downhole splitter assembly may reliably separate two or more strings within a conductor. The splitter assembly desirably maintains separation between the strings, which may then exit the conductor and may diverge outward thereafter utilizing directional drilling technology. A feature is that the splitter system is easy to manipulate, and does not cause performance problems when driving the conductor in the seabed.

With the splitter assembly in place, a drill bit may be lowered through the conductor and enter one embodiment of the splitter assembly, which may also be referred to as a downhole guide assembly, until it encounters one or two downwardly facing shunt plates or guide plates, which may block off the north end and the south end of the conductor bore. The drill bit is thereby forced in to a central east-west slot running across the bore. After the drill bit enters the slot, it may enter either the east hole or the west hole. The west hole, is, however, blocked by a plug having a top face sloping downwardly and toward the east hole. The drill bit thus slides down the plug face and is positioned over the desired east hole, such that the drill bit may subsequently pass through the splitter assembly. After drilling the east hole, a first casing string may be run through the east hole using the same splitter assembly. After running the first casing string, the operator may retrieve the plug with a running tool, thereby opening up the west hole. When the drill bit is thereafter lowered into the splitter assembly, it is pushed by the shunt plates into the central slot, but cannot enter the east hole because it is occupied by the first casing string. The drill bit thus enters the remaining west hole, so that the west hole may be drilled and a second casing string run in the west hole. The passive guidance provided by the splitter assembly may occur automatically, without the necessity of measurements, or locating, positioning or reciprocating motions to obtain the desired result of two separated strings in a single conductor.

In another embodiment, the splitter housing is positioned along the lower end of the conductor bore, with the splitter housing including a first bore and a second bore for separating a first well from the second well. A plug is positioned in one of the bores and includes a top face sloping downward toward the other bore. After one well has been drilled, and the casing installed in that well, the plug is retrieved to the surface so that the bit may enter the bore previously occupied by the plug.

According to a method of the invention, a technique for separating two or more tubular strings within a subsea conductor includes positioning a splitter housing along the lower end of the conductor bore, with the splitter housing including a first bore and a second bore for separating a first well from the second well. A plug is positioned in one of the bores including a top face sloping downward toward the other bore. A bit or other tool is then lowered to engage the top face of the plug and direct it toward the other bore.

These and further features and advantages of the present invention will become apparent from the following detailed description, wherein reference is made to the figures in the accompanying drawings.

BRIEF DESCRIPTION OF THE DRAWINGS

FIG. 14 illustrates the drill bit above the splitter assembly, while

FIG. 18 illustrates a second casing positioned above the splitter assembly, while

DETAILED DESCRIPTION OF THE PREFERRED EMBODIMENTS

A preferred splitter assembly 10 of the present invention provides for a conductor with nearly 100% full bore opening, and thereby easy driving into the seabed. The conductor pipe may be driven to refusal with a mechanical jamming action or may be jetted in place. The splitter assembly may subsequently be lowered into the well and interconnected with the lower end of the conductor to provide its separation function. The splitter assembly may then guide the bit, or other tools or tubulars, such as a casing string, into the proper sequenced bore.

Figure 1:
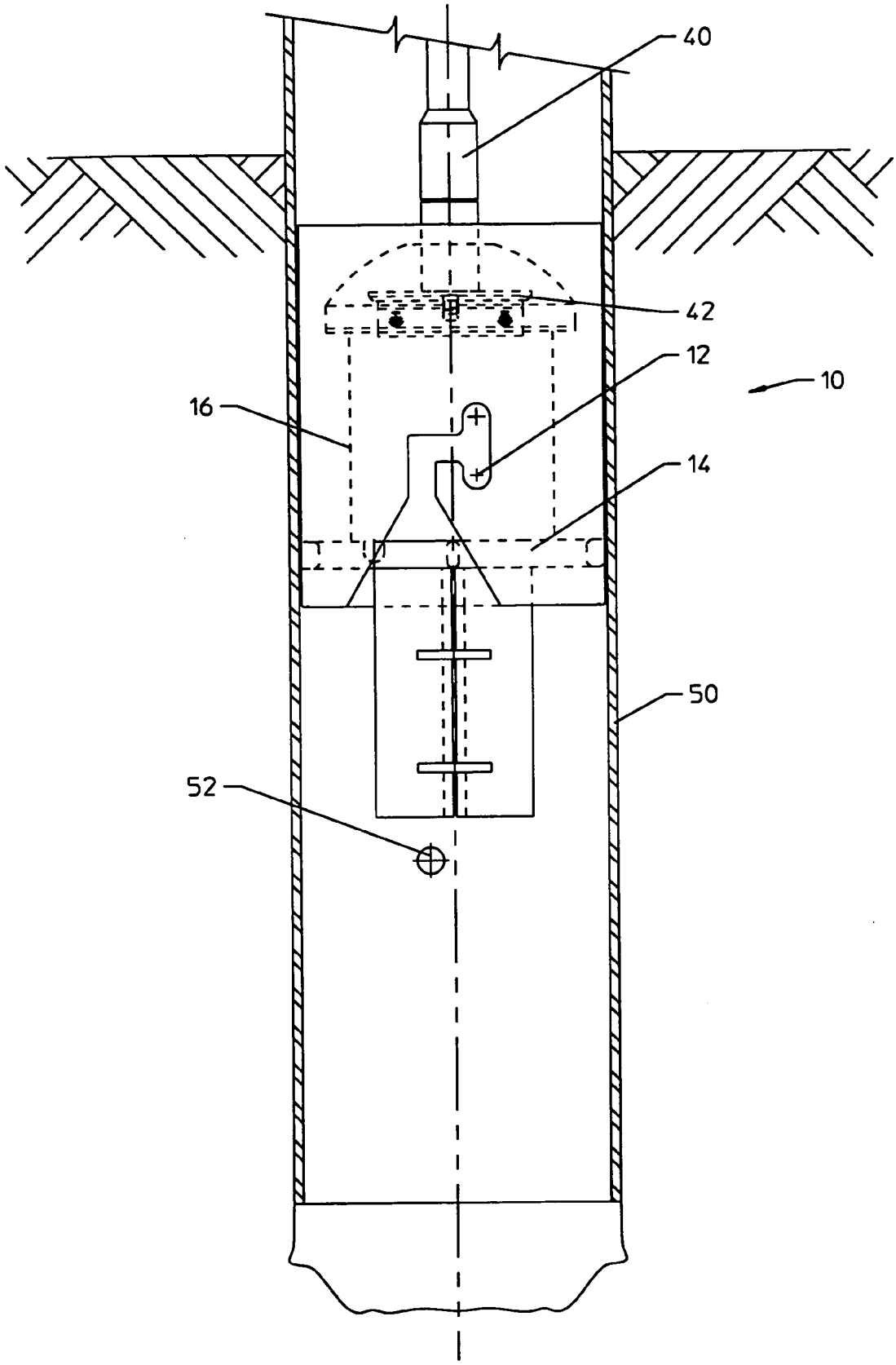
FIG. 1 is a cross sectional view of a conductor with engagement pins and a splitter assembly run in the well from a handling string to a position above the pins.
Figure 2:
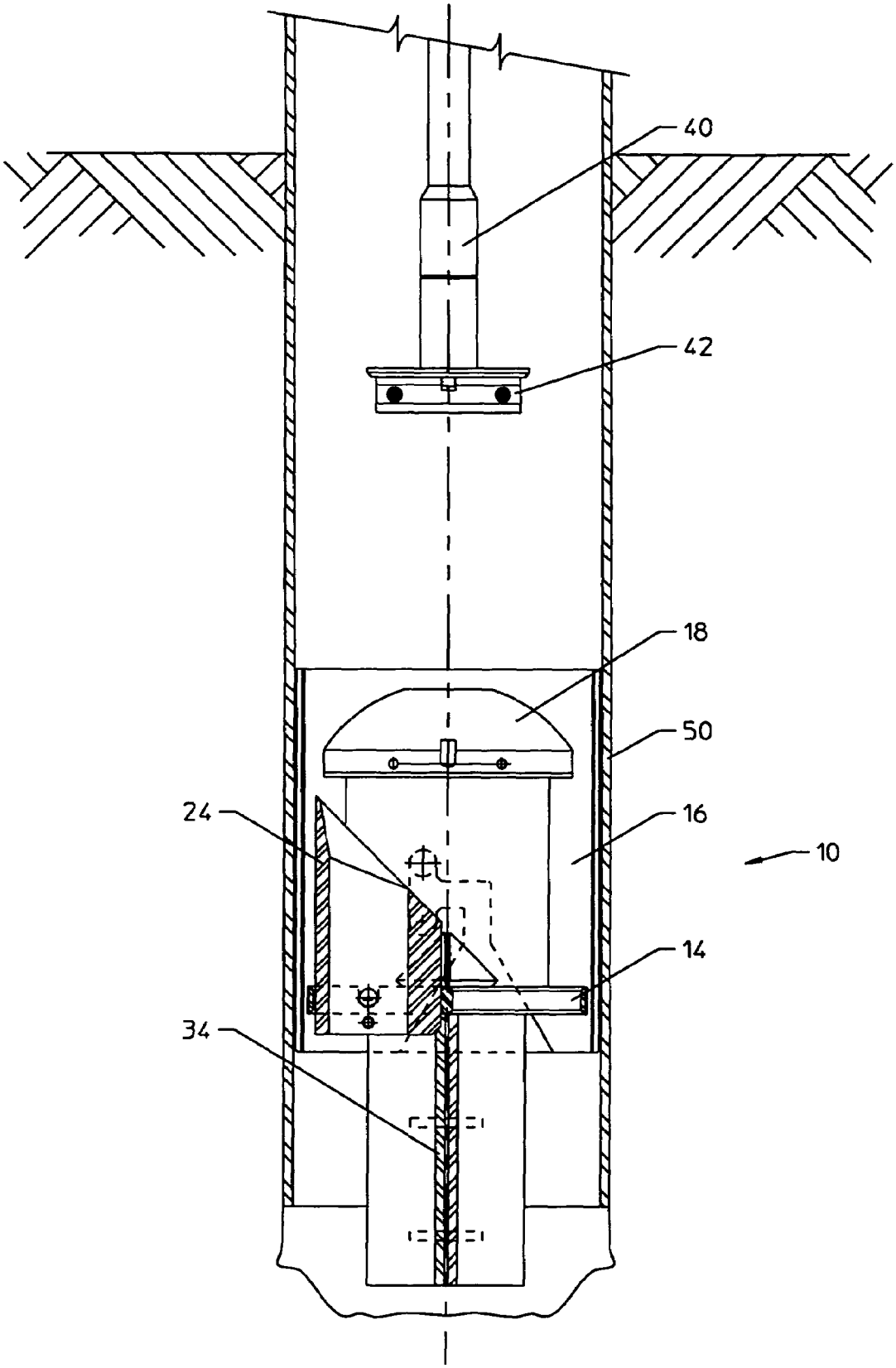
FIG. 2 is a cross sectional view of the splitter assembly landed in the conductor, with the running tool being retrieved to the surface.
Figure 3:
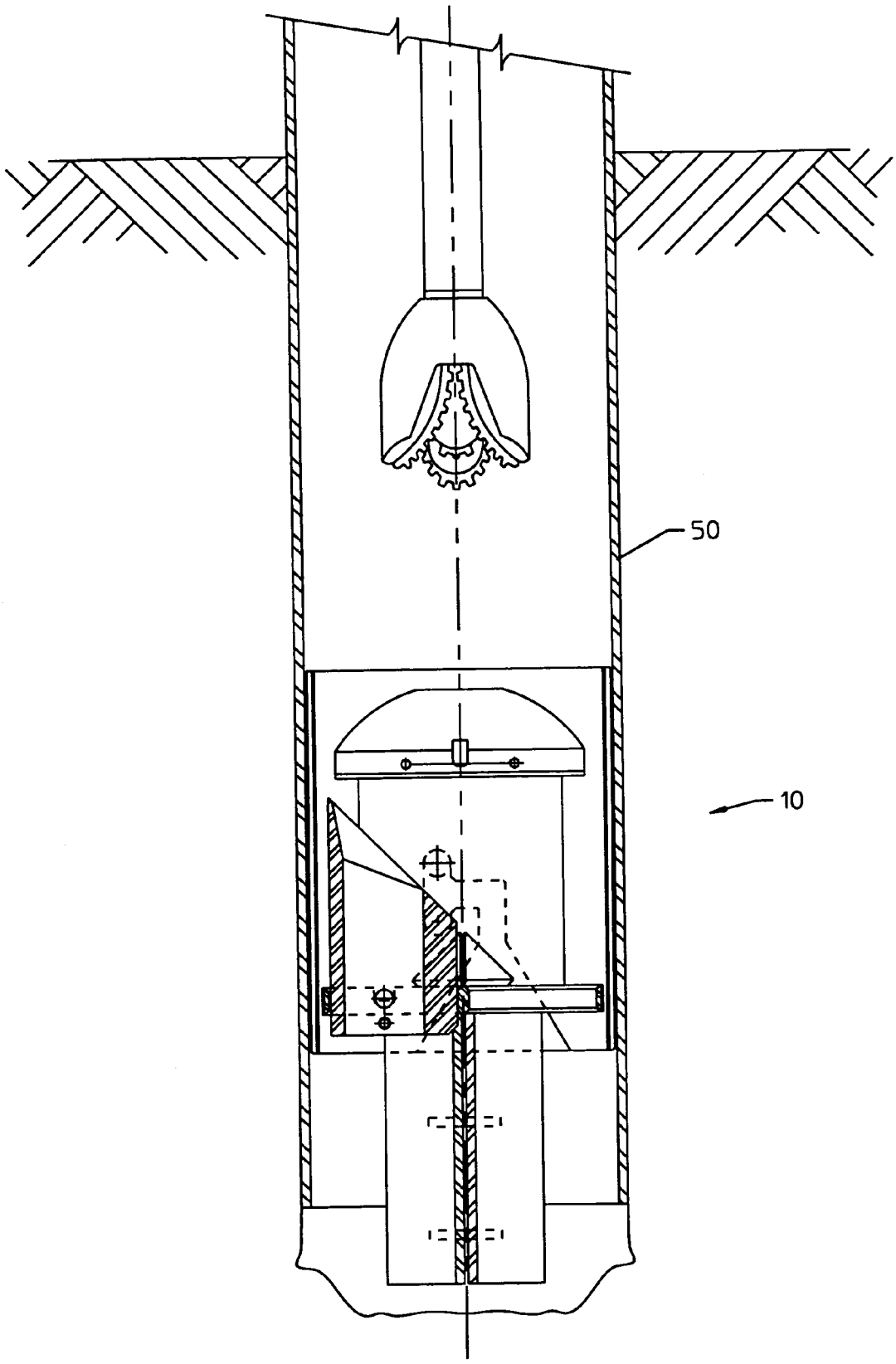
FIG. 3 illustrates a drill bit positioned above the splitter assembly.

As shown in FIG. 1, one joint of the conductor 50 may be provided with relatively small circumferentially spaced J-pins 52 each welded to the interior of the conductor. An upper pair of pins may serve to interact with J-slots 12 on the outside of the splitter assembly housing 14. A lower pair of pins (not shown) may prevent the splitter assembly housing from overshooting its desired locking function at the lower end of the conductor 50.

The splitter assembly 10 may be run in utilizing a handling or work strong 40 and a running tool 42, with the conductor 50 with pins 52 already secured in place. The housing 14 may include a relatively thin walled cylindrical sleeve 16 sized to fit within the conductor bore, even if the bore may have become egg-shaped during the driving operation. The wall of the sleeve may be strengthened with welded plates providing desired J-slot and funnel features. The J-slot, which alternatively may be another type of downhole slotting configuration used in oilfield operations, such as the T-slot, a V-slot, a W-slot, an X-slot or a Z-slot, provides axial retention of the splitter assembly 10 within the conductor 50 with controlled vertical movement.

Figure 4:
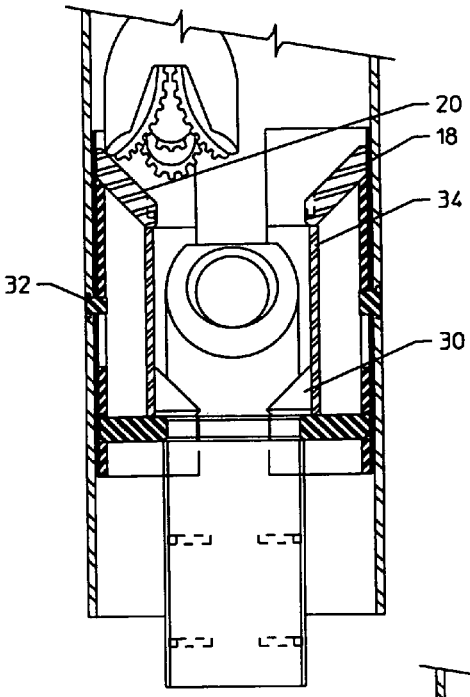
FIG. 4 illustrates a cutter cone of the rock bit engaging a shunt plate.

The funnel feature may provide rotational orientation of a lowered tool within the conductor 50. The splitter assembly shunt or guide plates 18 as shown in FIG. 4 may operate to divide the conductor into quadrants, with two quadrants for east and west holes, and the north and south quadrants being blocked (dead zones) due to the shunt plates. The splitter assembly may thus use a pair of shunt plates to initially guide the bit into a slot extending across the conductor, with the slot having a width substantially less than its length, which is substantially the internal diameter of the conductor. The flat plate surface 20 of a shunt plate over a dead zone may thus halt the bit's progress, allowing the operator to move the drill string sideways until the bit falls into one of the two separated holes, namely, the east hole or the west hole.

In a preferred embodiment, the splitter assembly separates the guiding function into sequential steps. The first step may centralize the motion away from the dead zones, and a second motion serves to guide the bit, tool or casing string into the desired hole. The first centralizing step may be accomplished by the guide plates 18 in the upper portion of the splitter assembly, so a bit descending towards either dead zone and will be guided toward a central slot 22, as shown in FIG. 4, over the common centerline of the two remaining holes.

Figure 5:
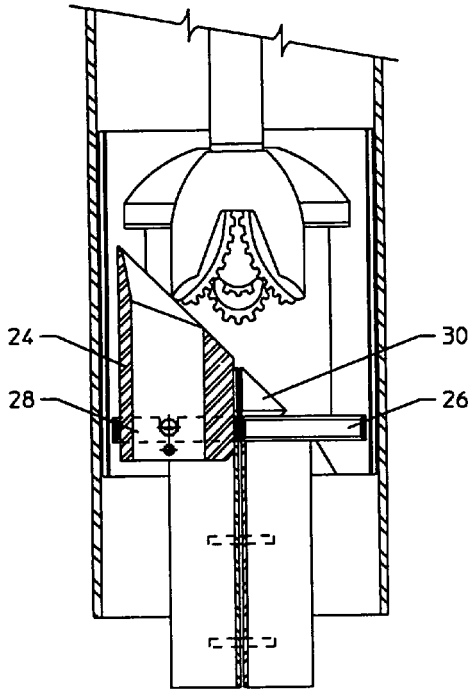
FIG. 5 illustrates the drill bit engaging a plug with an angled top surface.

The second guiding motion may be accomplished with a downwardly angled plug 24 that fits into a splitter assembly body, plate or housing 14, which includes two spaced holes 26, 28 as shown in FIG. 5 each sized to pass a bit. If desired, generally triangular shaped slide plates 30 may be used to provide additional guidance, thereby also urging the bit toward one of the two bores or holes. The plates 30 may each have an upper surface substantially parallel with the top face of the plug. Each of the plates 18 and 30 be inclined at a substantial angle of at least 20°, preferably at least 30°, and in many applications approximately 45°, relative to the central axis of the conductor.

Figure 6:
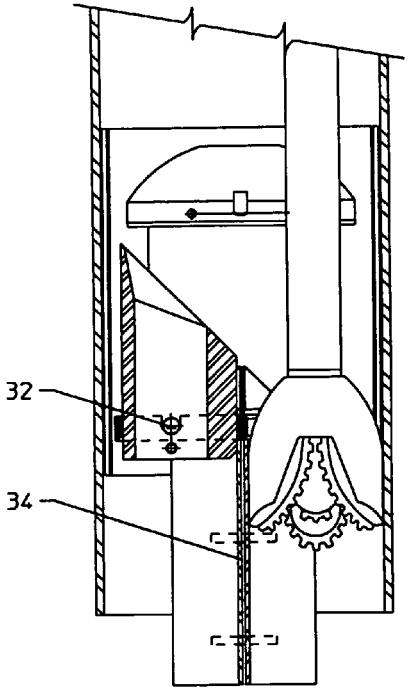
FIG. 6 illustrates the drill bit entering a bore in the splitter assembly.
Figure 7:
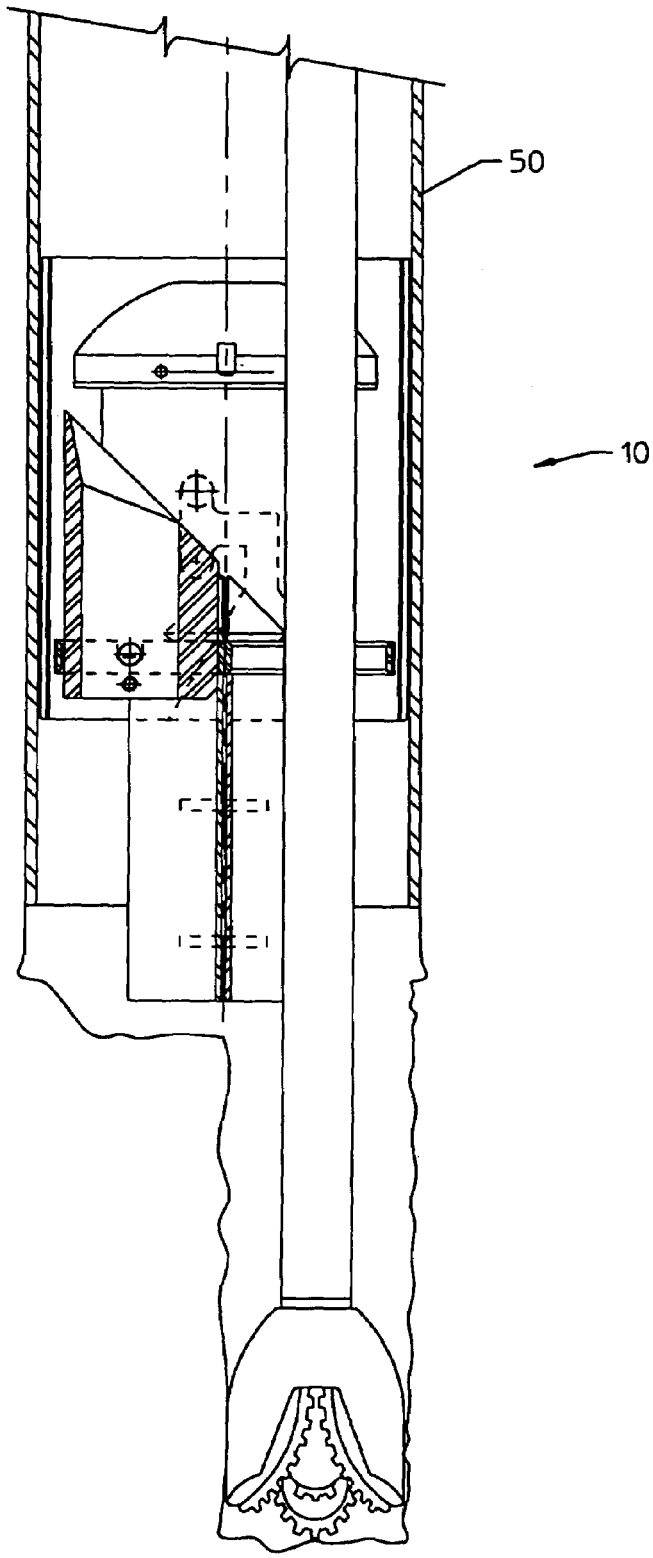
FIG. 7 illustrates the drill bit passing through the splitter assembly and drilling a first bore hole.
Figure 8:
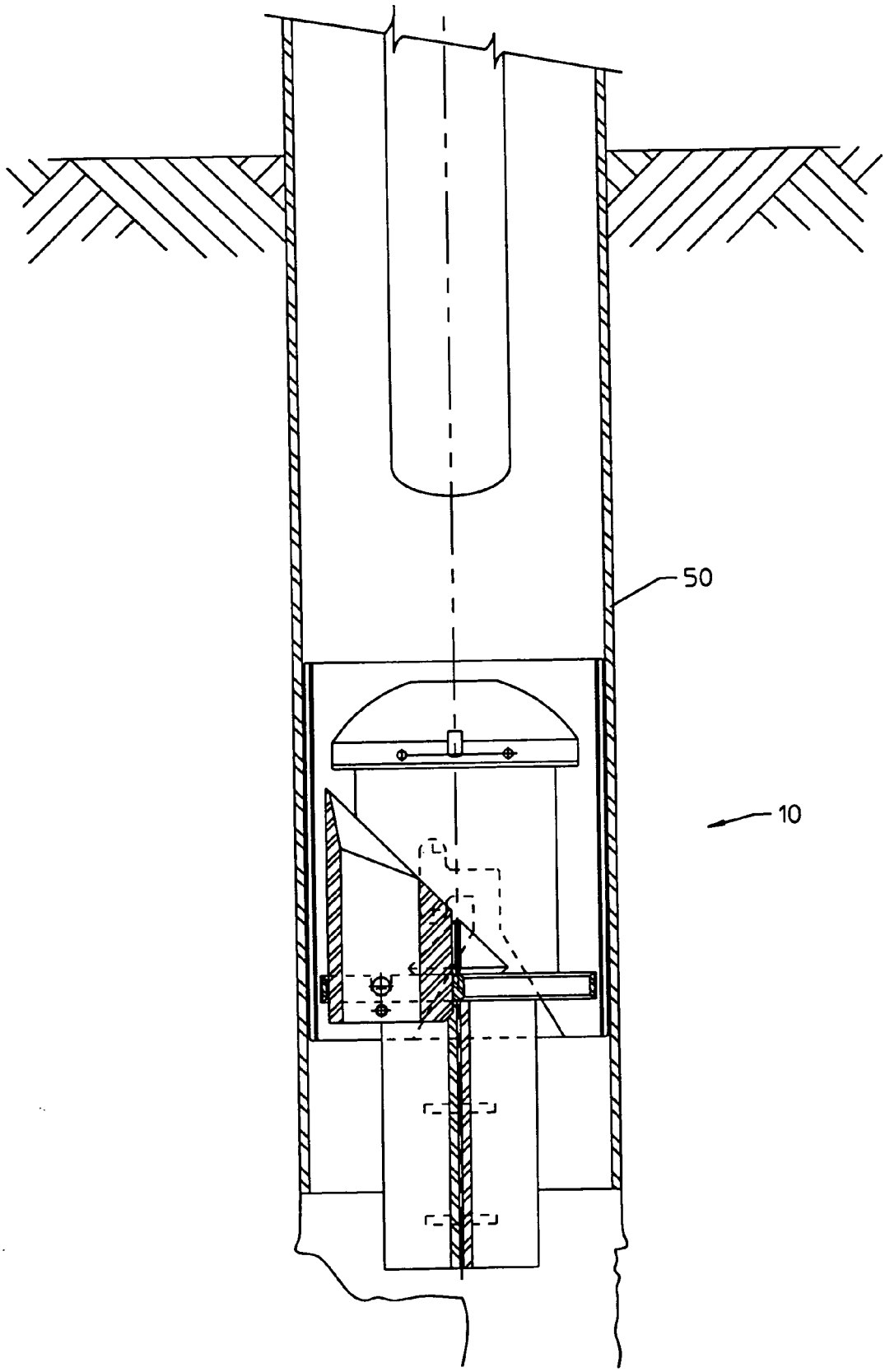
FIG. 8 illustrates a casing positioned above the splitter assembly, which may engage the splitter assembly as shown in FIG. 9 to pass through the splitter assembly as shown in FIG. 10.
Figure 9:
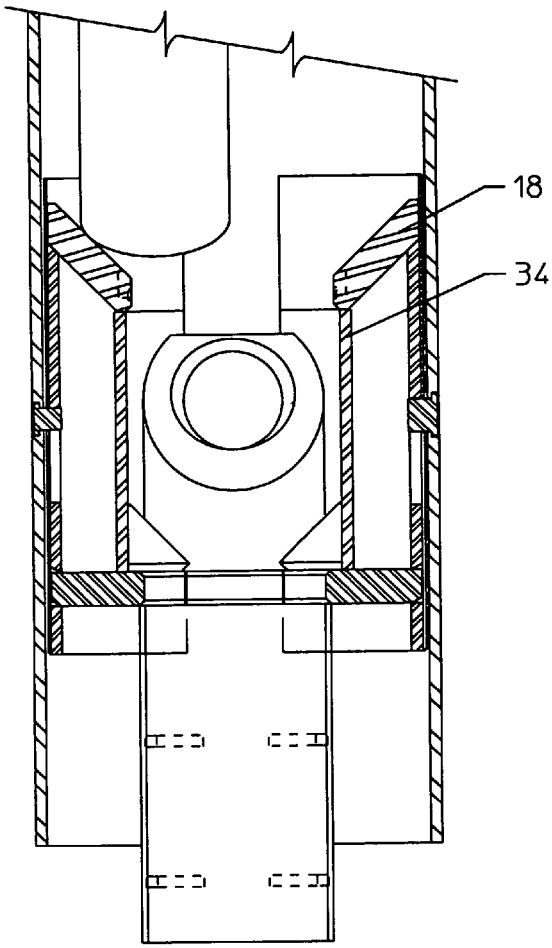
Figure 10:
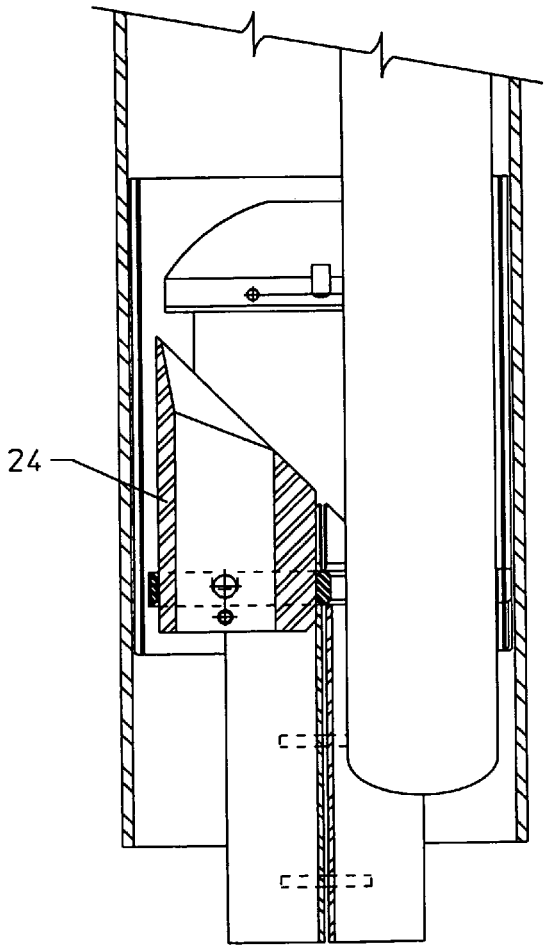

During operation, a drill string with a rock bit in the slot may slide down an angled plug 24 over the west hole. The plug may include spring mounted retracting support pins 32 and a beveled top face. The spring allows the pins to retract and pull the plug 24 from its opening in the splitter housing 14. The beveled top face 25 on the plug 24 directs the bit to the east hole, as shown in FIGS. 5 and 6. The plug may later be retrieved from the second bore 28 in the housing 14, as discussed below. A pair of vertical plates 34 may be used to block off the space below the guide plates, thereby preventing any lateral motion and hangup by tools passing through the splitter assembly. Half pipe sections forming tailpipes may have their lower ends slanted outwardly to deflect the drill string away from the centerline of the conductor.

Figure 12:
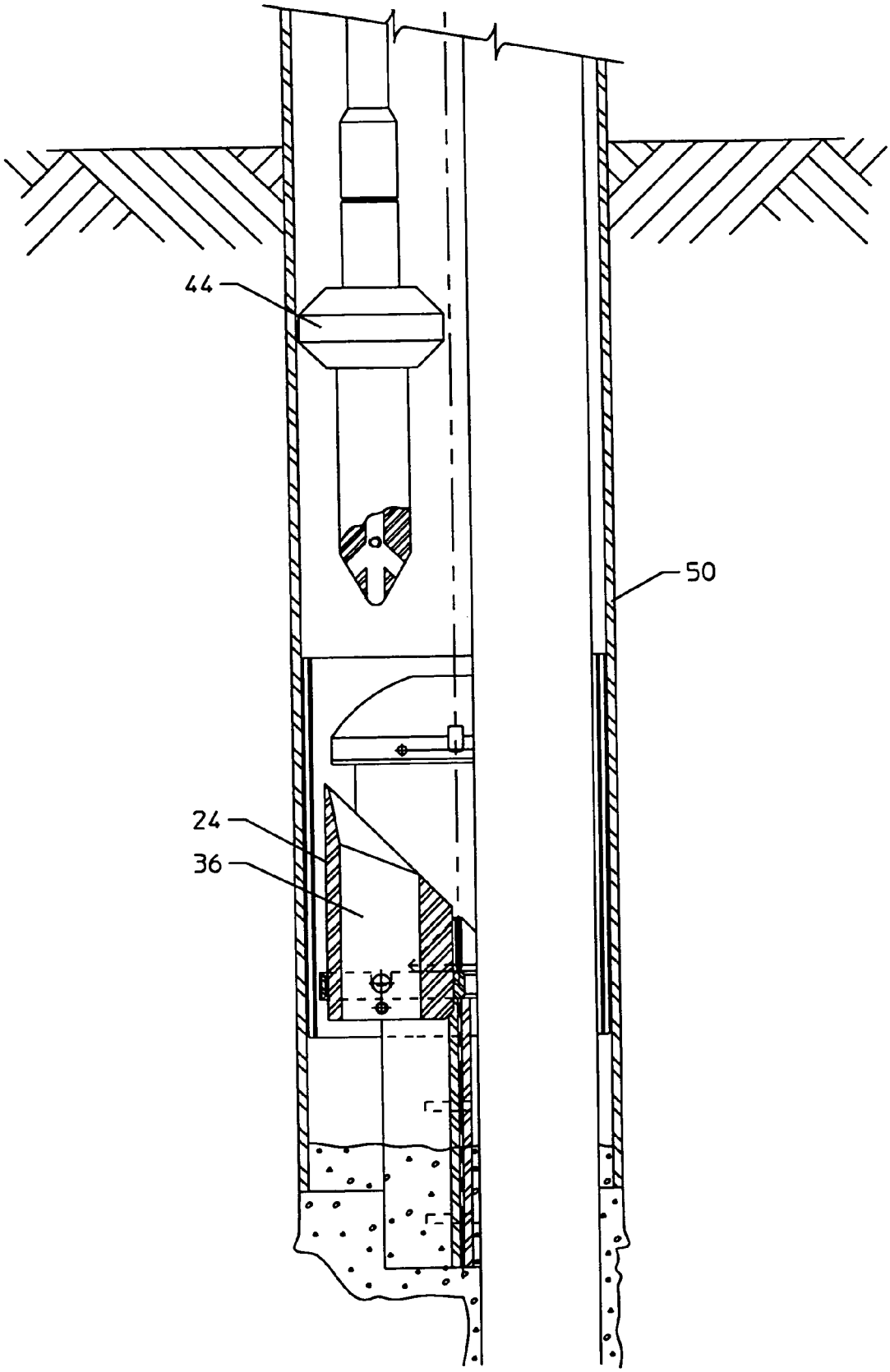
FIG. 12 illustrates a retrieving tool positioned on a handling string above the splitter assembly.
Figure 13:
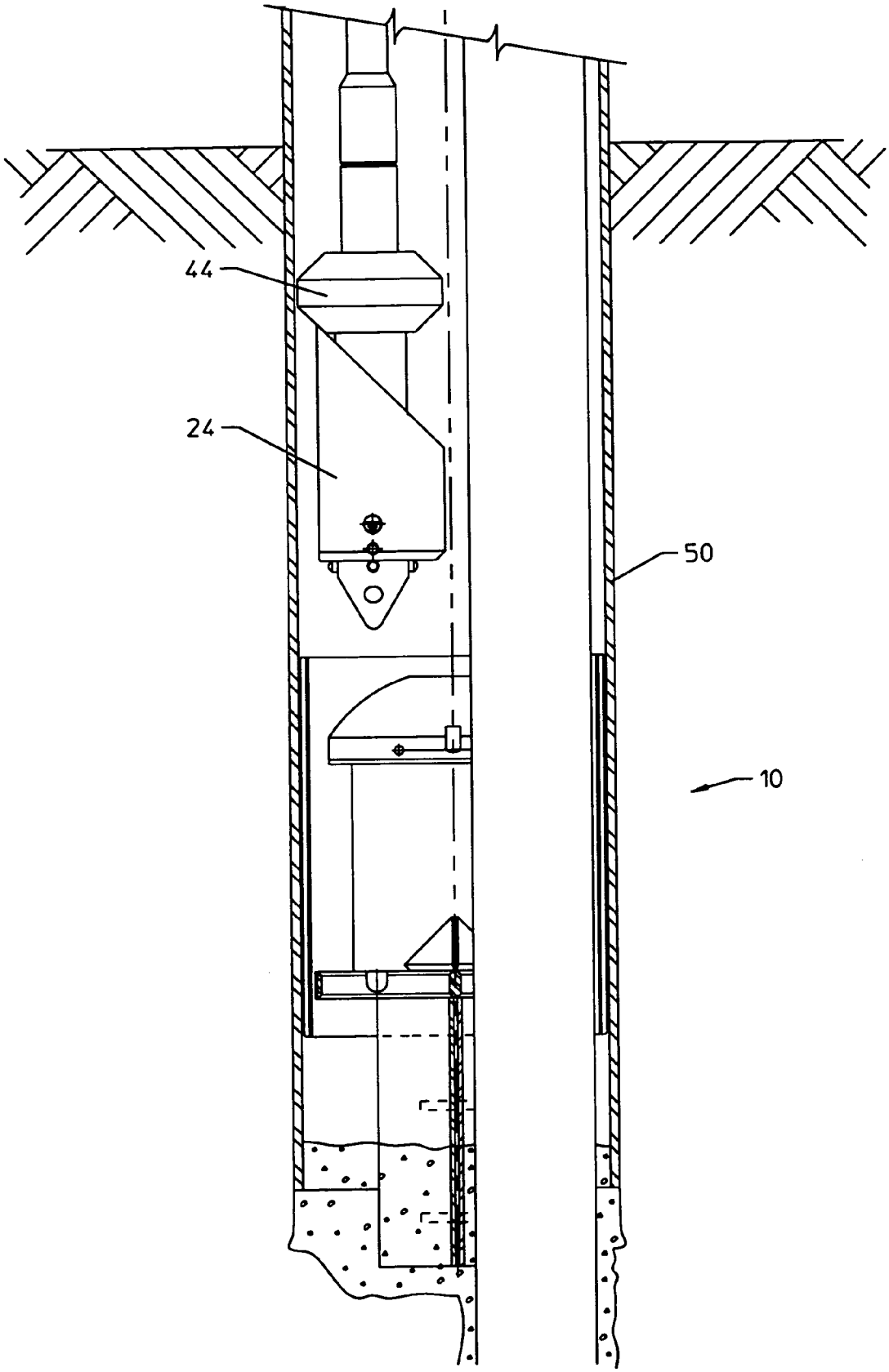
FIG. 13 illustrates the retrieval tool having disengaged the angled plug from the splitter housing.
Figure 14:
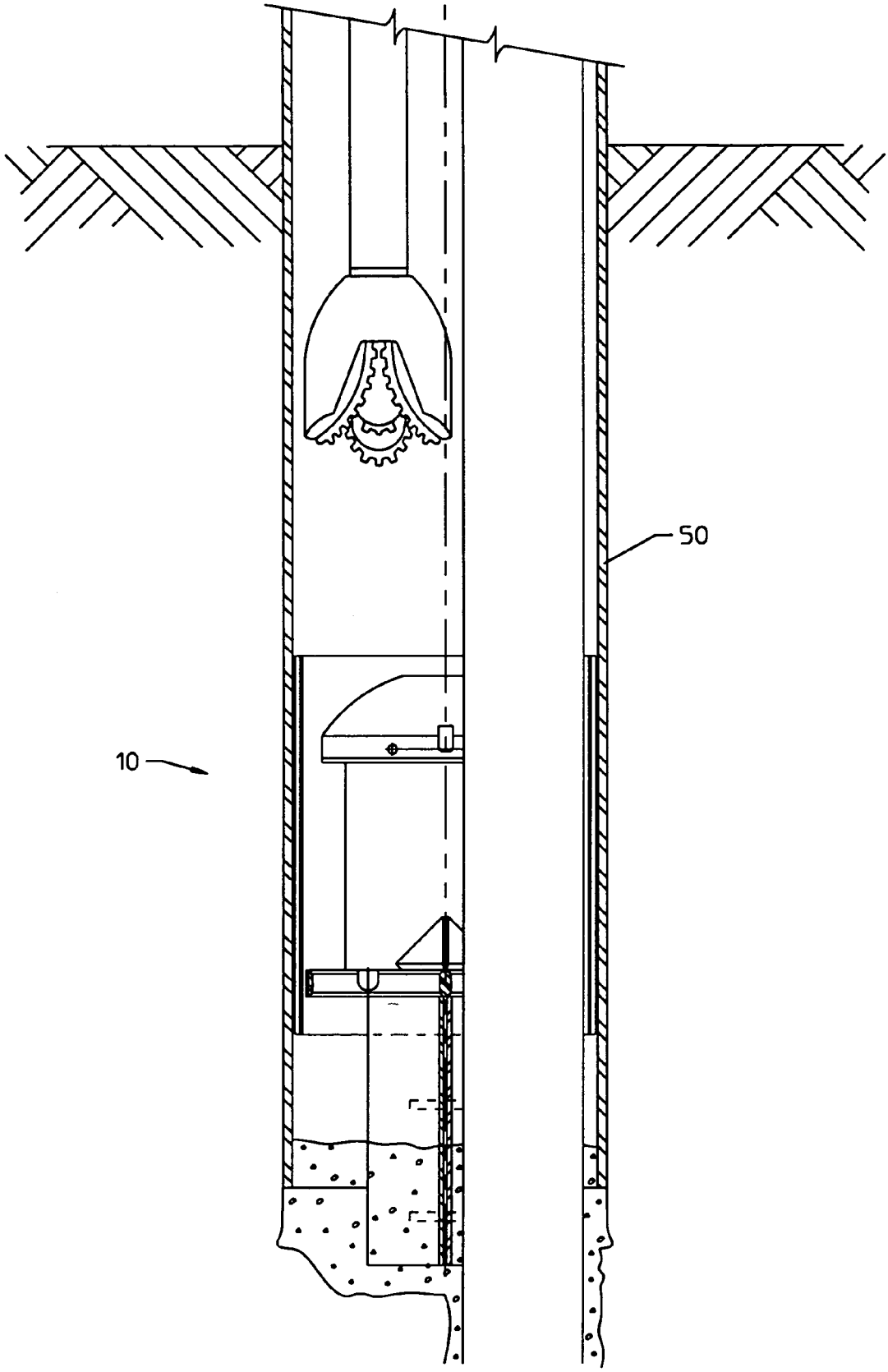
Figure 15:
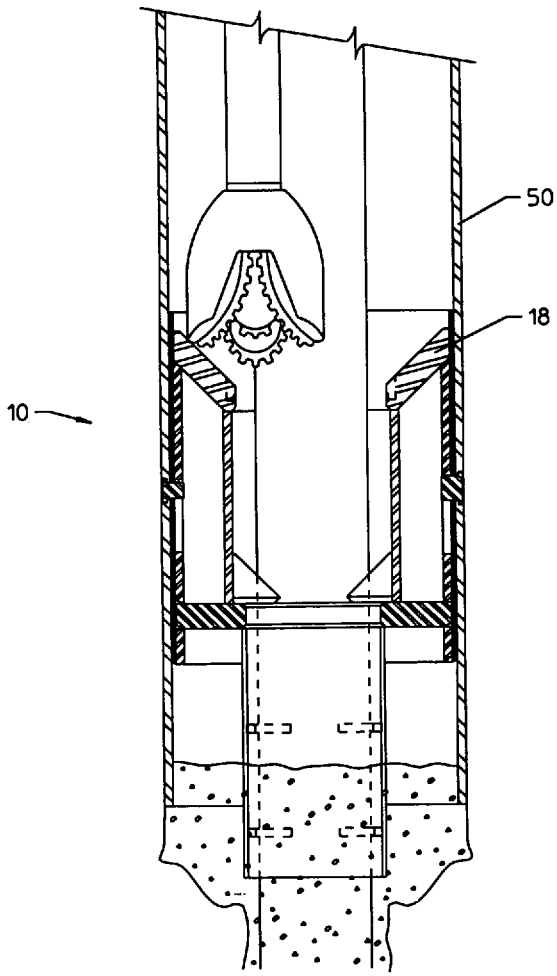
FIGS. 15 and 16 illustrate the drill bit passing through the splitter assembly for drilling the second bore hole as shown in FIG. 17.
Figure 16:
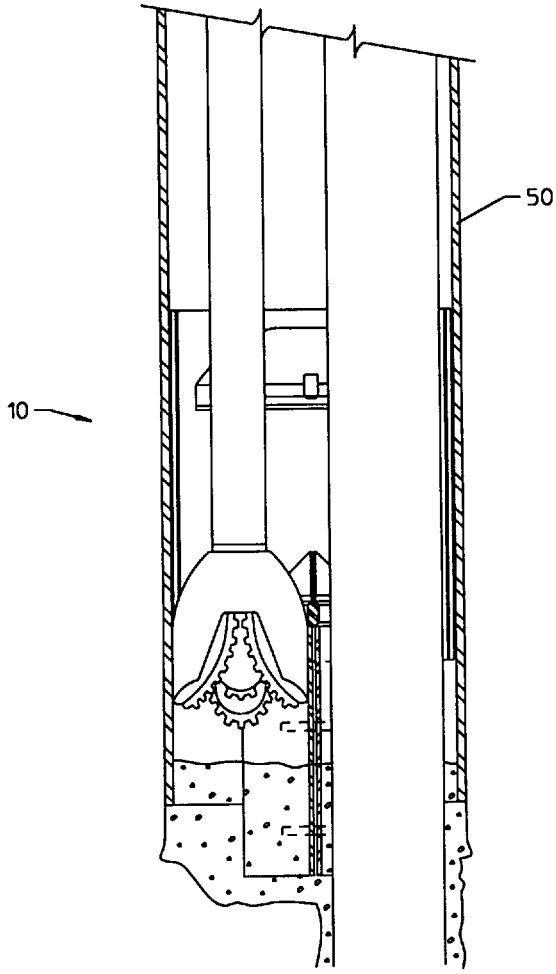
Figure 17:
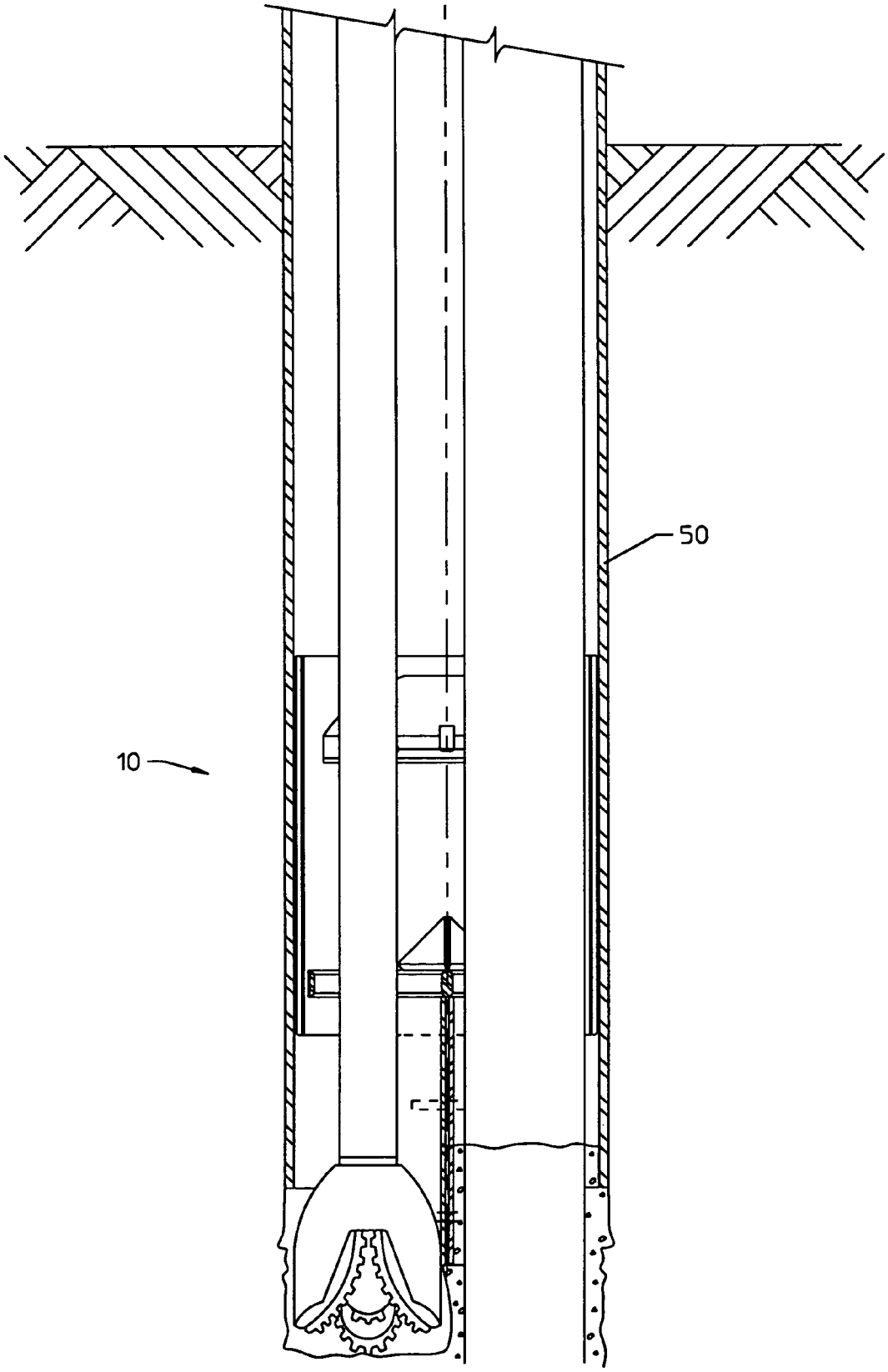
Figure 18:
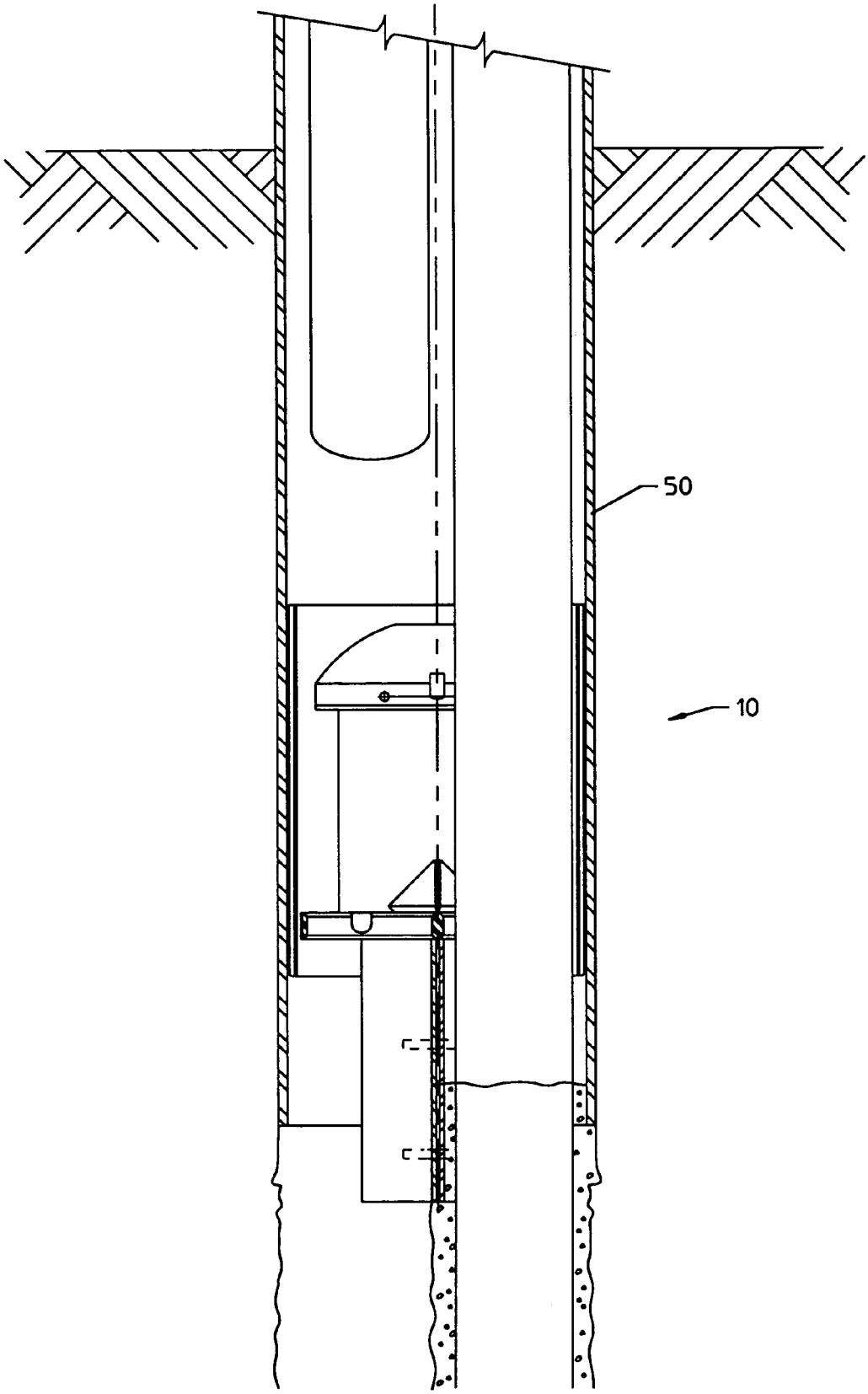
Figure 19:
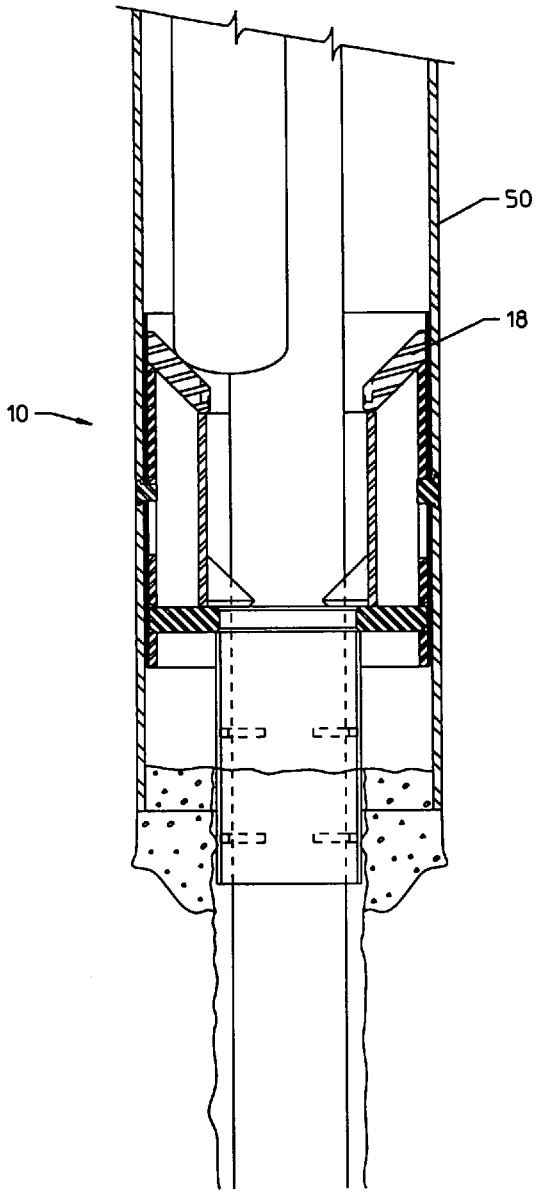
FIGS. 19 and 20 illustrates the second casing being passed through this splitter assembly for entry into the second drilled hole.
Figure 20:
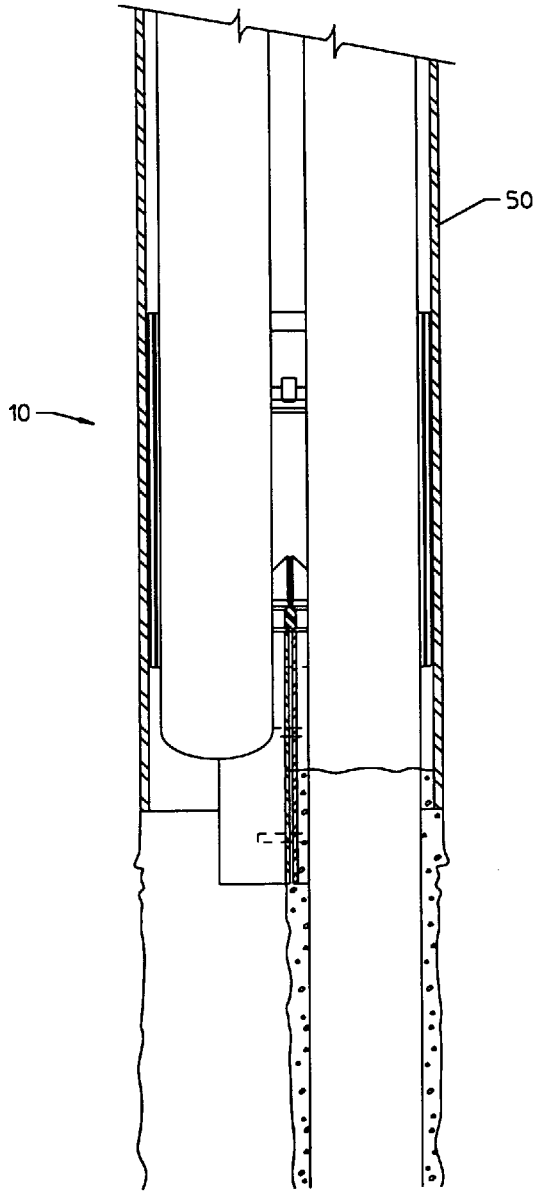
Figure 21:
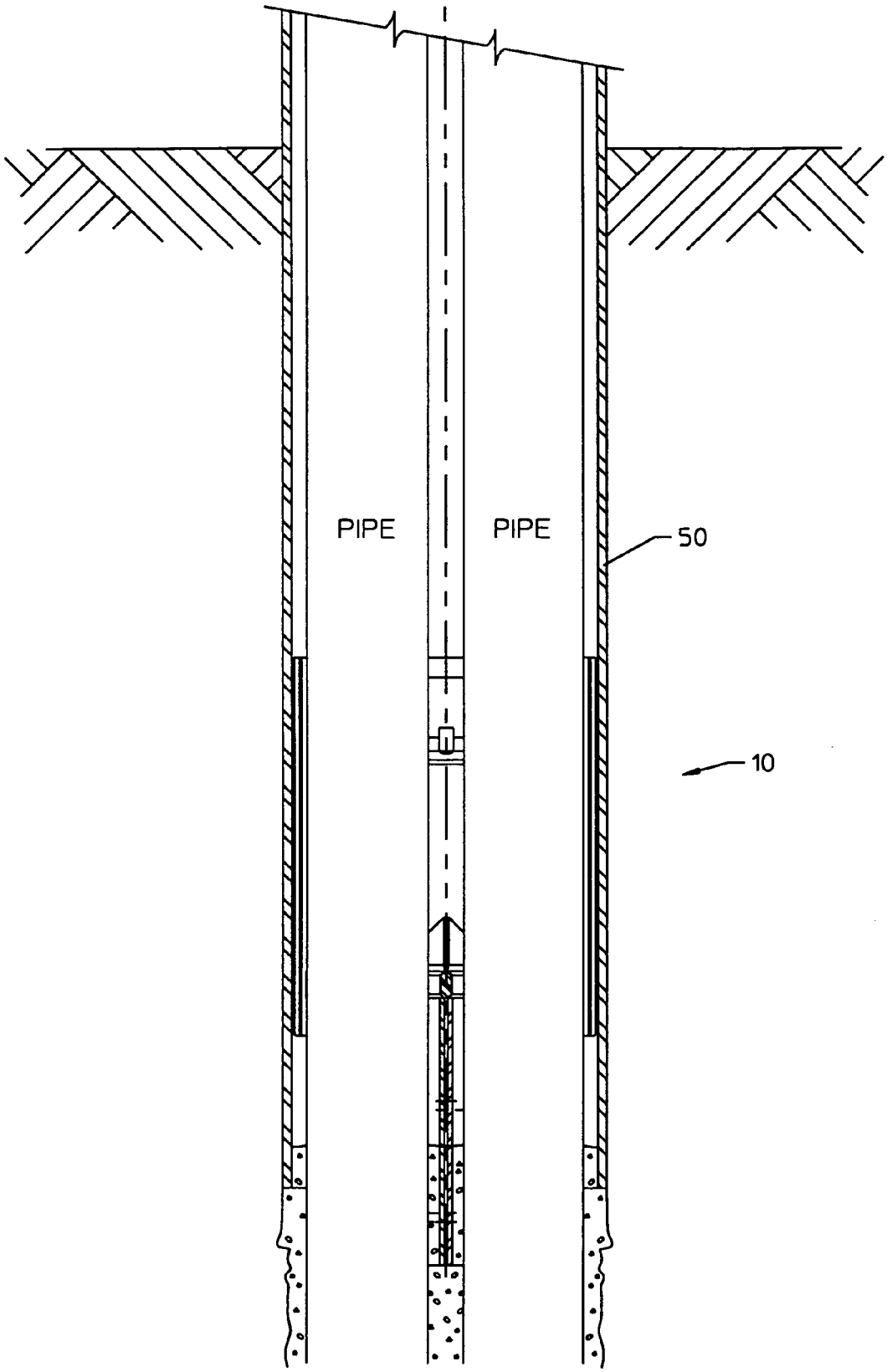
FIG. 21 illustrates two tubulars within a single conductor according to one embodiment of the invention.

After the first hole is drilled and a casing string run and cemented in place, the operator may remove the plug 24 from the second or west hole utilizing a slab-type running tool 44, as shown in FIG. 12, which enters the through bore 36 in the plug 24. The bore in the plug is, however, sufficiently small to prevent the bit from entering the plug bore. Drilling and running the second casing string in the second bore is simplified, since the west side of the slot is blocked off by the first casing string. Various designs for guide plates may prevent the tool 44 from wandering sideways and to guide the tool 44 as it is stabbed into the plug.

Two different pins may be used, one for proper orientation with respect to the conductor, and another set on the interior of the conductor to prevent overrun. Two stop pins may thus be located below the orientation J-pins. The splitter assembly will thus be oriented so that it is in proper alignment with the pins. The operator may then locate the splitter assembly to engage the J-slot with the J-pins, then lift to lock the splitter assembly in a locked piston within the J-slot. Confirmation that the splitter assembly has properly landed may be obtained by tensioning the handling string.

If the splitter assembly is aligned with the J-slots, but the J-pins are 180 degrees out of alignment, the splitter assembly will land high, with the oversized J-pin trying to enter the smaller J-slot. The operator may rotate to engage the proper J-slot with the proper pair of pins, and may then pick up to lock the splitter assembly in place. When locked in place, tension may shear a member, separating the running tool from the splitter housing, so that the running tool may be retrieved.

Figure 22:
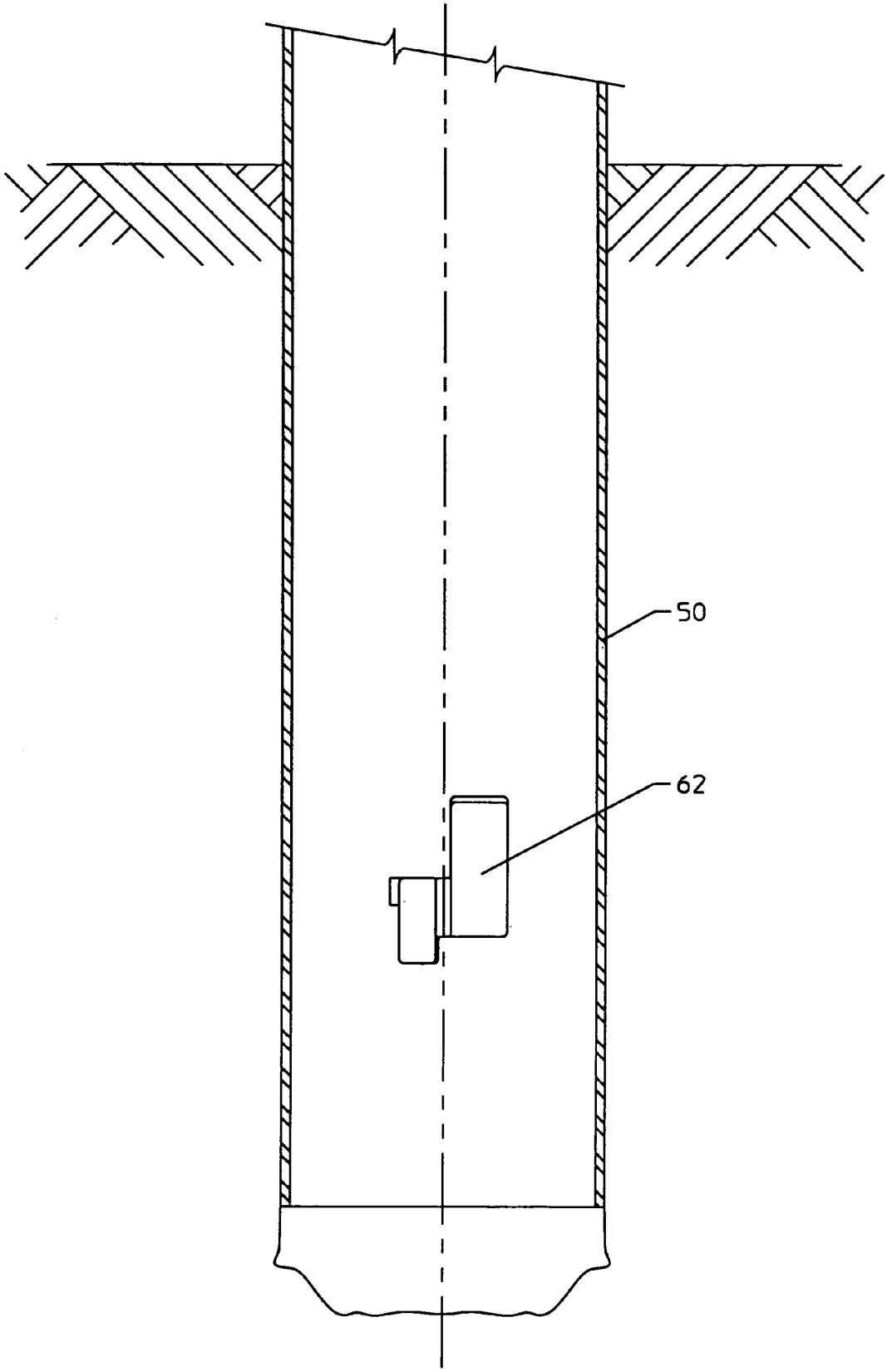
FIG. 22 illustrates Z slots in a casing, which may be used in conjunction with the spring-loaded key as shown in FIG. 23.
Figure 23:
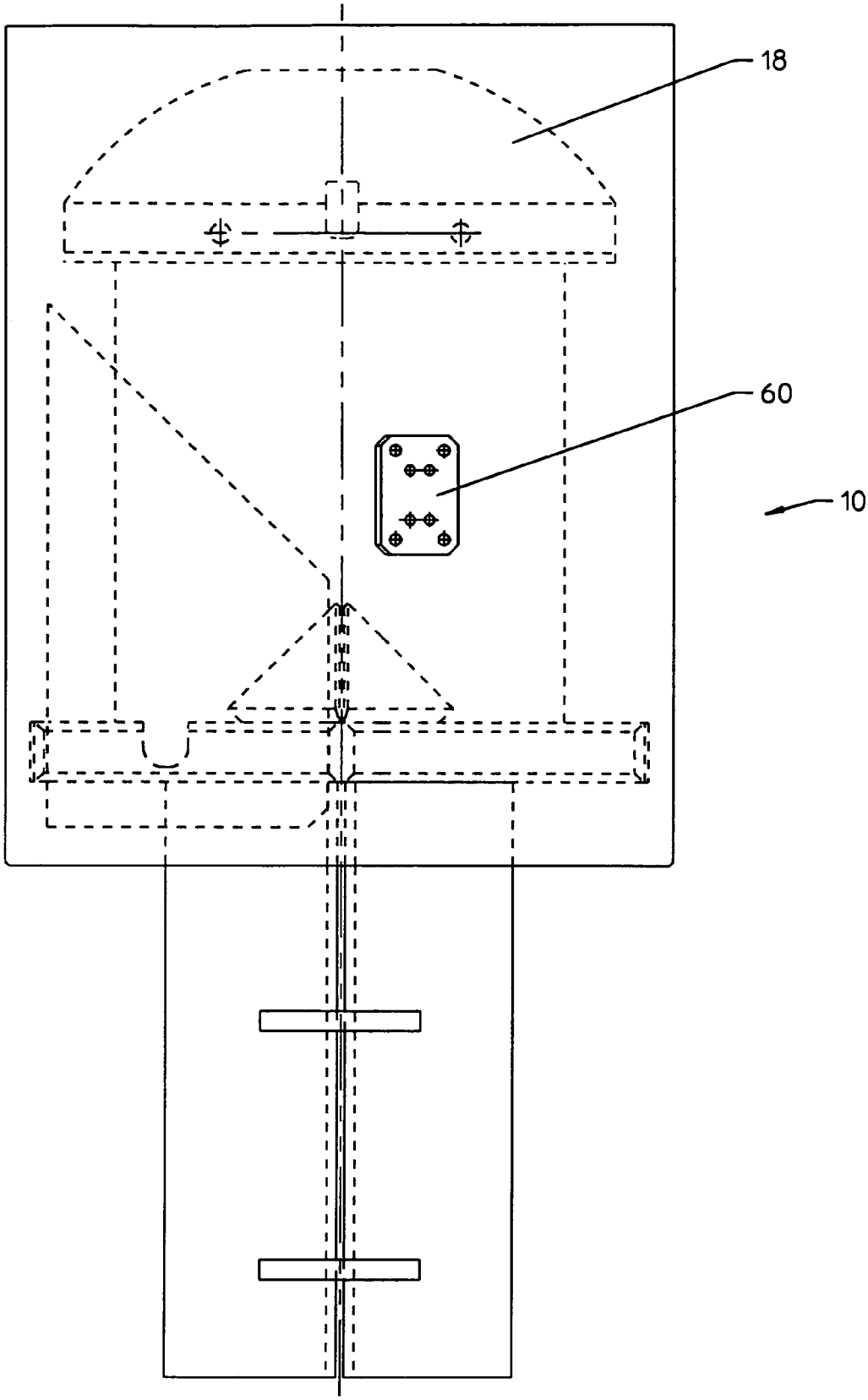

An alternative embodiment utilizes spring-loaded key plates 60 as shown in FIG. 23 which engage complementary slots 62 as shown in FIG. 22 in the inside wall of the conductor pipe 50. Thus no pins or other components need project radially inward from the conductor pipe. The key plates may then be sized so that rotation of the drill continues until the small key is in the small slot and the large key is in the large slot.

Figure 11:
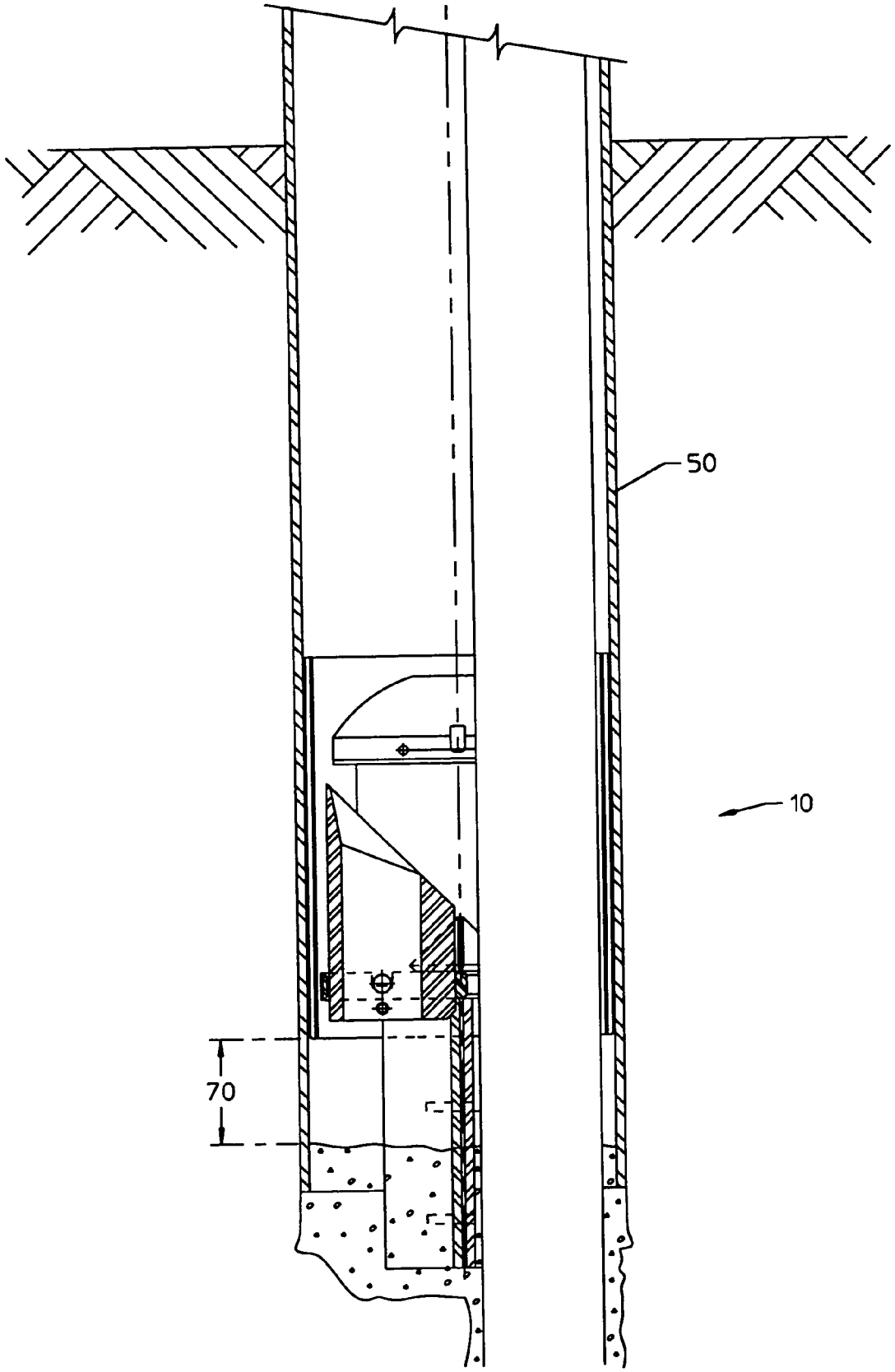
FIG. 11 illustrates a preferred cement overflow zone.

In another embodiment, the operator may be entering a drilled hole with a conductor having an integral cement shoe. In this application, the conductor thus is not jetted in place. The splitter assembly's outer sleeve may be eliminated, and the remaining components of the splitter assembly welded directly to the ID of the conductor. The plug described above may be installed into one of the two bores in the housing. The running tool may be stabbed into the shunt plates while simultaneously stabbing a stringer into a cement shoe. The tool may be cemented in place within the shoe. After the first casing string has been run into the east hole, a cement stringer may be run from the surface and threadably connected to a receiving pocket in the tool. Cement may be pumped through the splitter assembly, then out the cement shoe. After the cement has set, the string may be tensioned, and the tool may shear the shunt plates from the conductor. The splitter assembly cement flowpipes may separate at a desired breakpoint. The shunt plates and the angled top face of the plug may guide the bit to drill the first hole, so that a first casing may be run and cemented into the first hole. A cement overflow zone 70 as shown in FIG. 11 preferably is designed into the height of the conductor to prevent cementing the plug in the housing. The plugs may, however, be manufactured from aluminum or other easily drillable material, so that it may be drilled out if necessary to drill the second hole.

Variations of the equipment and procedure discussed above allow plugs each with the downwardly angled surface to direct a bit to a selected hole, rather than using the combination of guide plates and a plug. For example, the splitter assembly may include three holes for three wells. A high plug angled downwardly may be provided in one hole, and a low plug angled downwardly may be provided in the second hole. Both plugs would thus divert the drill bit to the lower open hole.

Figure 24:
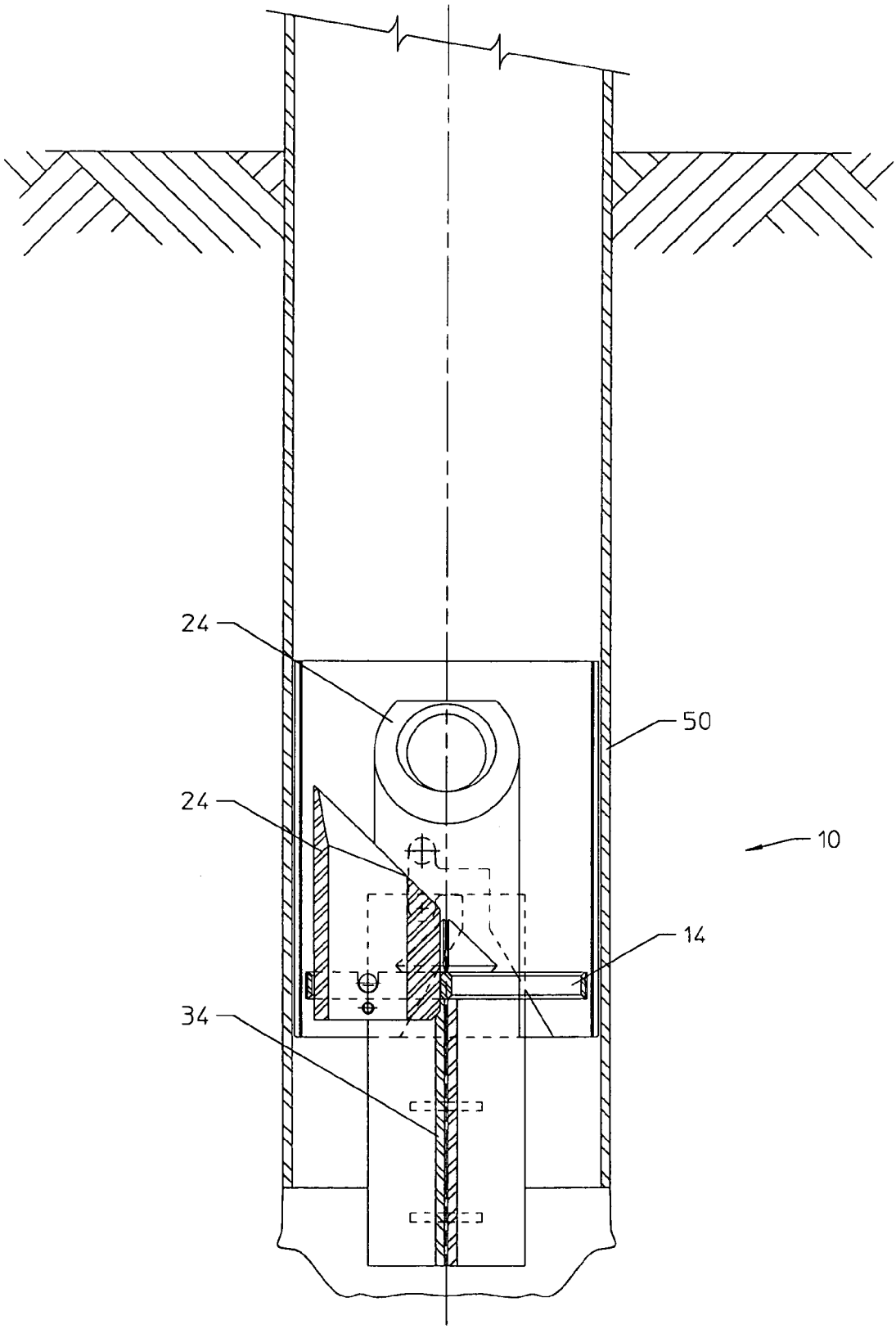
FIG. 24 illustrates an embodiment of a splitter assembly for use with three wells.

FIG. 24 discloses another embodiment of a splitter assembly 10 within a conductor 50. For this application, three spaced holes in the splitter assembly are provided each for one of three wells, with the holes being positioned within the conductor 50 in a generally triangular pattern. The back hole has a tall plug 24 positioned therein with a top face slanted forward. The left side hole has a short plug 24 therein with its top face slanted toward the right side hole, with no plug in this hole. A bit or other tool lowered through the conductor may thus engage one of the two plugs 24 and will be directed to the open hole. Once that hole has been drilled and a pipe positioned in that hole, the left side plug may be removed, so the drill bit will then be guided by the back plug to the left side hole, and cannot enter the right side hole. Once the left side hole has been drilled a pipe position in that hole, the rear plug may be retrieved to the surface and a well drilled through the rear hole and a pipe positioned in that hole. FIG. 24 shows the vertical plates 34 discussed previously, although in this instance the plates will not extend across the conductor and will extend across only the front portion thereof to separate the left side hole from the right side hole.

Various components may be substituted for those illustrated. For example, the shunt plates are functioning as guide plates, and various types of guide members having angled upper guide surfaces may serve as the guide plates or shunt plates. Shunt plates may have a planar discharge edge, as disclosed herein, or shunt plates could have a curved discharge edge. Similarly, J-pins and slot arrangements, and keys and slot arrangements, have been disclosed for landing and axially interconnecting the splitter assembly with the lower end of the conductor. Various other locking devices will be apparent to those skilled in the art. Preferably, the removable interconnection between the splitter assembly and the conductor is provided by radially inward directed members on the conductor fitting within slots in the splitter assembly, or by radially outwardly projecting members on the splitter assembly which fit within slots in the conductor.

The splitter assembly as disclosed herein may be used in applications where two wells are drilled from a single conductor. Based on the above explanation, those skilled in the art should appreciate that the splitter assembly may be modified so that three or more wells may be drilled from the same conductor. For example, by removing the shunt plate over the north zone of the conductor, and retaining the shunt plate over the south zone, and by positioning a top plug in the north zone, and a lower plug in the west zone, the east hole may first be drilled. The lower plug may be removed so that the west hole is then drilled, and the top plug removed so that the north hole is drilled. Similarly, the south shunt plate may also be removed, and top, middle and lower plugs provided to ensure the proper sequencing for the drilled holes.

According to the method of separating two or more tubular strings within a subsea conductor, a splitter housing is positioned along a lower end of the conductor bore, with a splitter housing including a first bore and a second bore for separating the first well from the second well. A plug is positioned in one of the bores and includes a top face sloping downwardly toward the other bore. A bit and later a casing string are lowered to engage the top face of the plug and direct the bit toward the other bore. Subsequently, the plug is retrieved and a bit is then lowered into the bore which was previously occupied by the plug. One or more guide plates may be secured to the splitter housing above the plug for guiding the bit toward one of the first bore and the second bore. If the conductor is jetted in place within the seabed, the splitter housing is preferably positioned along the conductor bore after the conductor is secured in place.

In another embodiment, the method may include positioning a second plug in a second hole of the splitter housing, with the second plug having a top face sloping downward toward a third hole in the splitter housing. The splitter housing preferably is secured to the conductor by a latching mechanism.

Figure 25:
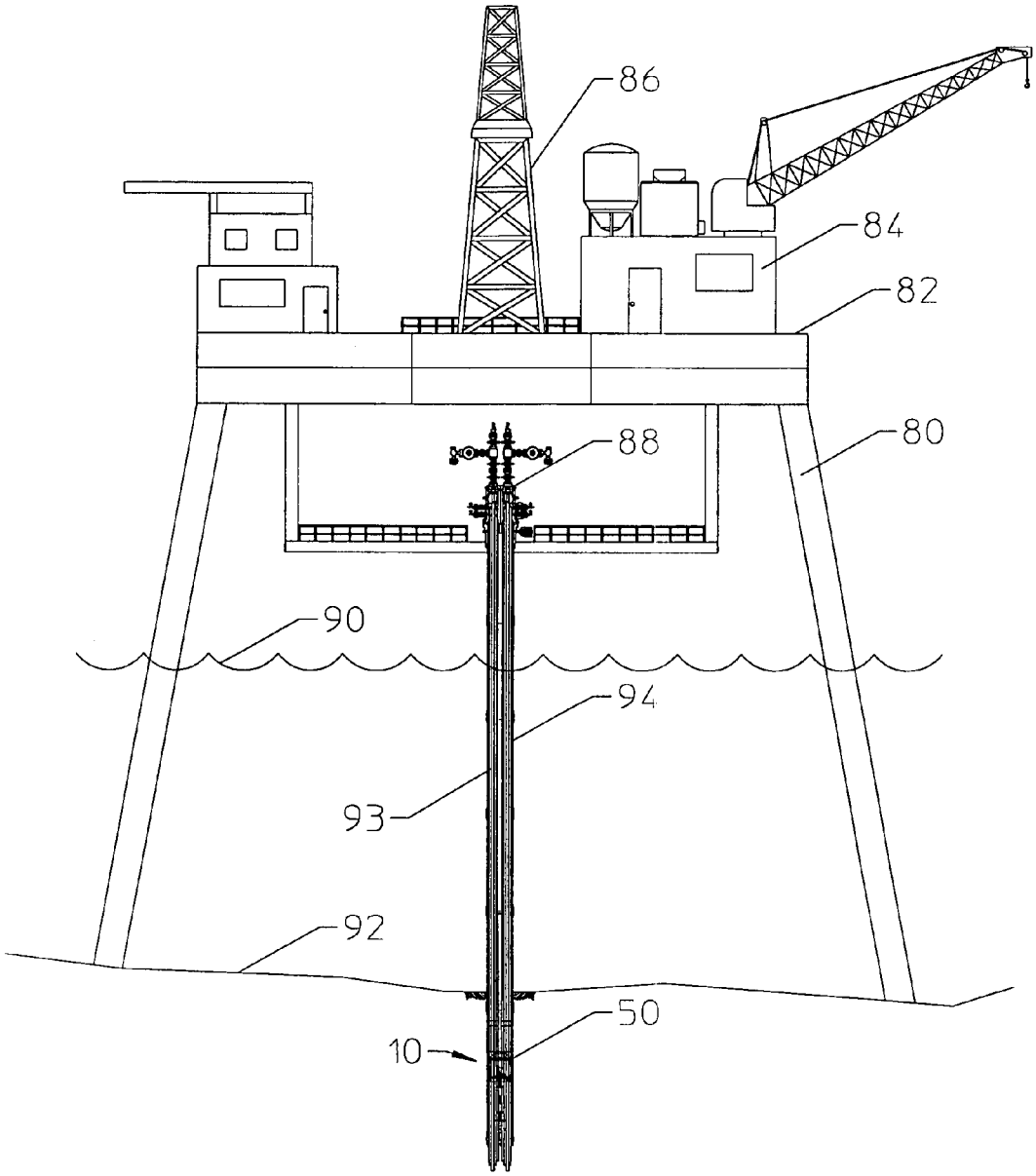
FIG. 25 illustrates a splitter assembly in a conductor beneath an offshore rig.

FIG. 25 discloses a suitable environment for the splitter assembly 10, including a conductor extending into the seabed. The system alternatively could be used in a floating offshore platform. This figure also depicts a suitable position for the splitter assembly.

The splitter assembly 10 is typically positioned within a conductor 50, and below the mud line 72. The system for the present invention may thus be used when drilling wells from a offshore platform 80 having a deck 82 with conventional equipment, such as crane 84 and derrick 86 positioned on the deck of the platform. A representative valve assembly 88 is shown for controlling flow to and from tubulars 93 and 94 which extend from the valve assembly 88, through the waterline 90 to the conductor 50 and through the splitter assembly 10, as discussed above.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

The invention claimed is:

1. A downhole splitter assembly for separating two or more tubular strings within a subsea conductor, comprising:

a splitter housing positioned along a lower end of the conductor bore, the splitter housing including a first bore and a second bore for separating a first well from a second well;

a plug in one of the bores including a top face sloping downwardly toward the other bore; and one or more guide plates secured to the splitter housing and circumferentially spaced from the plug in the one of the bores for guiding a tool toward one of the first bore and the second bore.

2. A downhole splitter assembly as defined in claim 1, wherein the one or more guide plates comprises a pair of guide plates each sloping downwardly toward a slot area between the pair of guide plates each above the first bore and the second bore.

3. A downhole splitter assembly as defined in claim 2, wherein each of the pair of guide plates are circumferentially spaced from the plug.

4. A downhole splitter assembly as defined in claim 1, further comprising:

one or more slide plates below the guide plates for guiding the tool toward one of the first and second holes.

5. A downhole splitter assembly as defined in claim 4, wherein the slide plates have an upper surface substantially parallel with the top face of the plug.

6. A downhole splitter assembly as defined in claim 1, wherein the splitter housing is positioned along the conductor bore after the conductor is secured in place.

7. A downhole splitter assembly as defined in claim 1, further comprising:

a second plug in a second hole, the second plug having a second top face sloping downward toward a third hole in the splitter housing.

8. A downhole splitter assembly as defined in claim 1, wherein the splitter housing is secured to the conductor bore by the latching mechanism.

9. A downhole splitter assembly as defined in claim 8, wherein the conductor includes one or more radially inward projecting members for securing the splitter housing to the conductor.

10. A downhole splitter assembly as defined in claim 8, wherein the conductor includes one or more slots for receiving radially outward projecting members to secure the splitter housing to the conductor.

11. A downhole splitter assembly as defined in claim 1, wherein the splitter housing includes a sleeve shaped body.

12. A downhole splitter assembly as defined in claim 1, further comprising:

a retrieving tool for retrieving the plug.

13. A downhole splitter assembly as defined in claim 1, wherein the plug includes a bore for receiving a portion of a retrieving tool.

14. A downhole splitter assembly for separating two or more tubular strings within a subsea conductor, comprising:

a splitter housing positioned along a lower end of the conductor bore, the splitter housing including a first bore and a second bore for separating a first well from a second well;

a plug in one of the bores including a top face sloping downwardly toward the other bore;

the plug including a bore for receiving a portion of a retrieving tool;

one or more guide plates secured to the splitter housing and positioned above the plug for guiding a tool toward one of the first bore and the second bore; and the retrieving tool for retrieving the plug from the splitter housing.

15. A downhole splitter assembly as defined in claim 14, wherein the one or more guide plates comprises a pair of guide plates each sloping downwardly toward a slot area between the guide places above the first bore and the second bore.

16. A downhole splitter assembly as defined in claim 14, wherein the splitter housing is positioned along the conductor bore after the conductor is secured in place.

17. A downhole splitter assembly as defined in claim 16, wherein the splitter housing is secured to the conductor bore by the latching mechanism.

18. A downhole splitter assembly as defined in claim 17, wherein the conductor includes one or more radially inward projecting members for securing the splitter housing to the conductor.

19. A downhole splitter assembly as defined in claim 17, wherein the conductor includes one or more slots for receiving radially outward projecting members to secure the splitter housing to the conductor.

20. A downhole splitter assembly as defined in claim 14, further comprising:

one or more slide plates below the guide plates for guiding the tool toward one of the first and second holes.

21. A downhole splitter assembly as defined in claim 14, further comprising:

a second plug in a second hole, the second plug having a second top face sloping downward toward a third hole in the splitter housing.

22. A method of separating two or more tubular strings within a subsea conductor, comprising:

positioning a splitter housing along a lower end of the conductor bore, the splitter housing including a first bore and a second bore for separating a first well from a second well;

positioning a plug in one of the bores including a top face sloping downwardly toward the other bore;

positioning a second plug in a second hole, the second plug having a second top face sloping downward toward a third hole in the splitter housing; and lowering a bit to engage the top face of the plug and direct the bit toward the other bore.

23. A method as defined in claim 22, further comprising:

securing one or more guide plates to the splitter housing above the plug for guiding the bit toward one of the first bore and the second bore.

24. A method as defined in claim 23, further comprising:

securing one or more slide plates below the guide plates for guiding the bit toward one of the first and second holes.

25. A method as defined in claim 23, further comprising:

circumferentially positioning each of the one or more guide plates from the plug.

26. A method as defined in claim 22, further comprising:

positioning the splitter housing along the conductor bore after the conductor is secured in place.

27. A method as defined in claim 26, further comprising:

securing the splitter housing to the conductor bore by the latching mechanism.

28. A method as defined in claim 22, further comprising:

retrieving the plug prior to drilling the second well.

* * * * *